United States Patent [19]

Paine

[11] Patent Number: 4,761,045

[45] Date of Patent: Aug. 2, 1988

[54] DRAWER AND CABINET ASSEMBLY

[75] Inventor: George W. Paine, Manistee, Mich.

[73] Assignee: Metalworks, Inc., Ludington, Mich.

[21] Appl. No.: 52,990

[22] Filed: May 22, 1987

[51] Int. Cl.[4] ..... E05B 65/41

[52] U.S. Cl. ..... 312/219; 312/216

[58] Field of Search ..... 312/107.5, 216–222; 108/107, 109

[56] References Cited

U.S. PATENT DOCUMENTS

| | | | |
|---|---|---|---|
| 1,006,605 | 10/1911 | Tilton | 312/220 X |
| 1,608,153 | 11/1926 | Anderson | 108/109 |
| 2,966,384 | 12/1960 | Bergman | 312/218 |
| 3,175,872 | 3/1965 | Sullivan | 312/107.5 |
| 3,199,683 | 8/1965 | Graswich | 108/109 |
| 3,791,208 | 2/1974 | Signore | 312/221 |
| 3,866,993 | 2/1975 | Dean et al. | 312/216 |
| 3,883,199 | 5/1975 | Cawley, Jr. et al. | 312/216 |

*Primary Examiner*—Joseph Falk

*Attorney, Agent, or Firm*—Ian C. McLeod

[57] ABSTRACT

A drawer lock subassembly (16) for one or more drawers (25 and 26) is described. The assembly includes stop members (18) which are secured in hole (17*a*) in a slide member (17) mounted in a recess lip. The slide member is held in place by a clip (23) on a subassembly (15) which holds the slide member in place for vertical sliding movement in the recess. The stop member is moved by the slide member into a locked or unlocked position by a key (19*a*) activating a lever (22).

15 Claims, 5 Drawing Sheets

DRAWER AND CABINET ASSEMBLY

Figure 2:
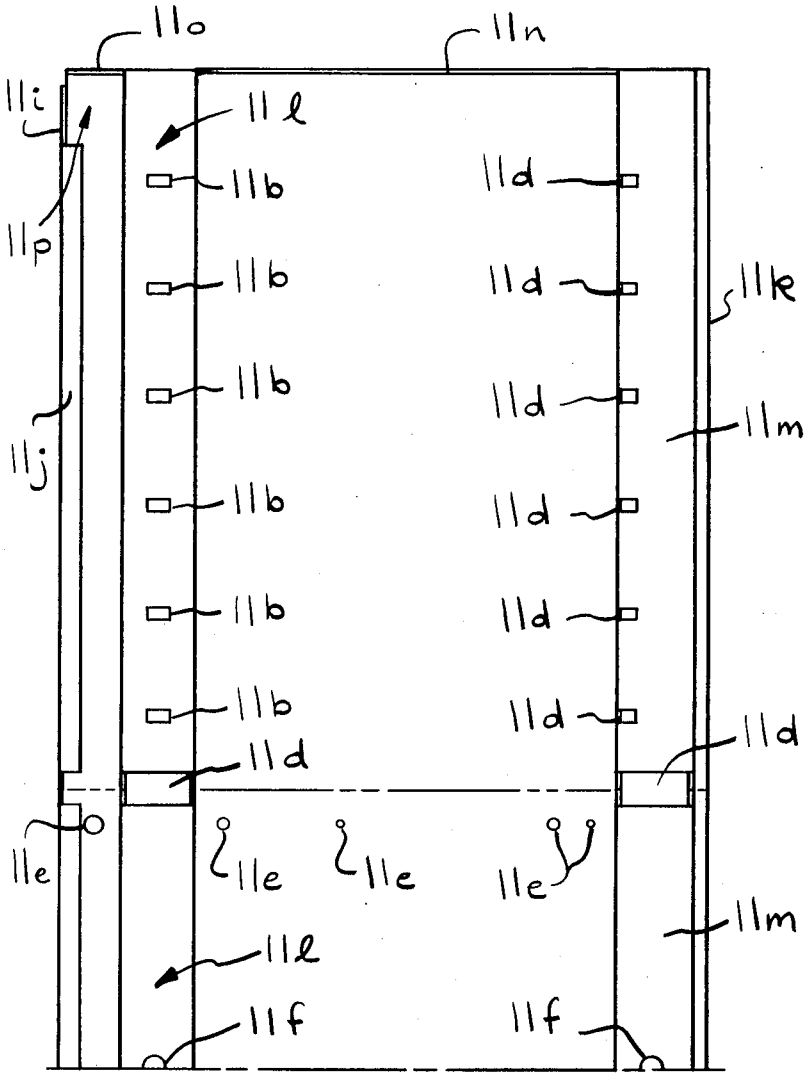

BACKGROUND OF THE INVENTION (1) Summary of the Invention

The present invention relates to an improved lockable drawer and cabinet assembly. In particular the present invention relates to an improved and simplified drawer lock assembly.

(2) Prior Art

The prior art has provided drawer and cabinet assemblies wherein each drawer is mounted on dual sliding tracks which move horizontally into and out of the cabinet. The problem is to lock the drawers against movement by turning a key. This is usually accomplished by providing stop members which are moved upon opening one drawer into the line of movement of one of the sliding tracks for each drawer to thereby prevent the drawers from opening.

The prior art has used stop members which are bolted to the face of a vertically oriented member and slideable in a preformed box shaped channel mounted on one side of the cabinet by turning a key in a lock. The vertically oriented member forms a backbone supporting the stop members which are secured by bolts to the vertically oriented member. The stop members slide vertically against the walls of the channel. In this prior art cabinet and drawer assembly the channel must be separately and precisely formed and the stop members tend to bind in the channel, particularly if there is any warping of the channel during assembly of the cabinet. This construction is also expensive because of the need to form and install the channel and to precision form the stop members to fit in the channel. Also the bolts for securing the stop members to the vertically oriented member are an extra expense and the bolts can come loose because of attempted opening of the drawers when the stops are blocking the tracks in the locked position.

OBJECTS

It is therefore an object of the present invention to provide drawer and cabinet assembly with an improved lock assembly for locking the drawers against opening which eliminates the need for a separately formed channel mounted in the cabinet and which eliminates the potential for binding of the stop members. Further it is an object of the present invention to provide a lockable drawer and cabinet assembly which is very simple and economical to fabricate and assemble and which is reliable in use. These and other objects will become increasingly apparent by reference to the following description and the drawings.

IN THE DRAWINGS

Figure 1:
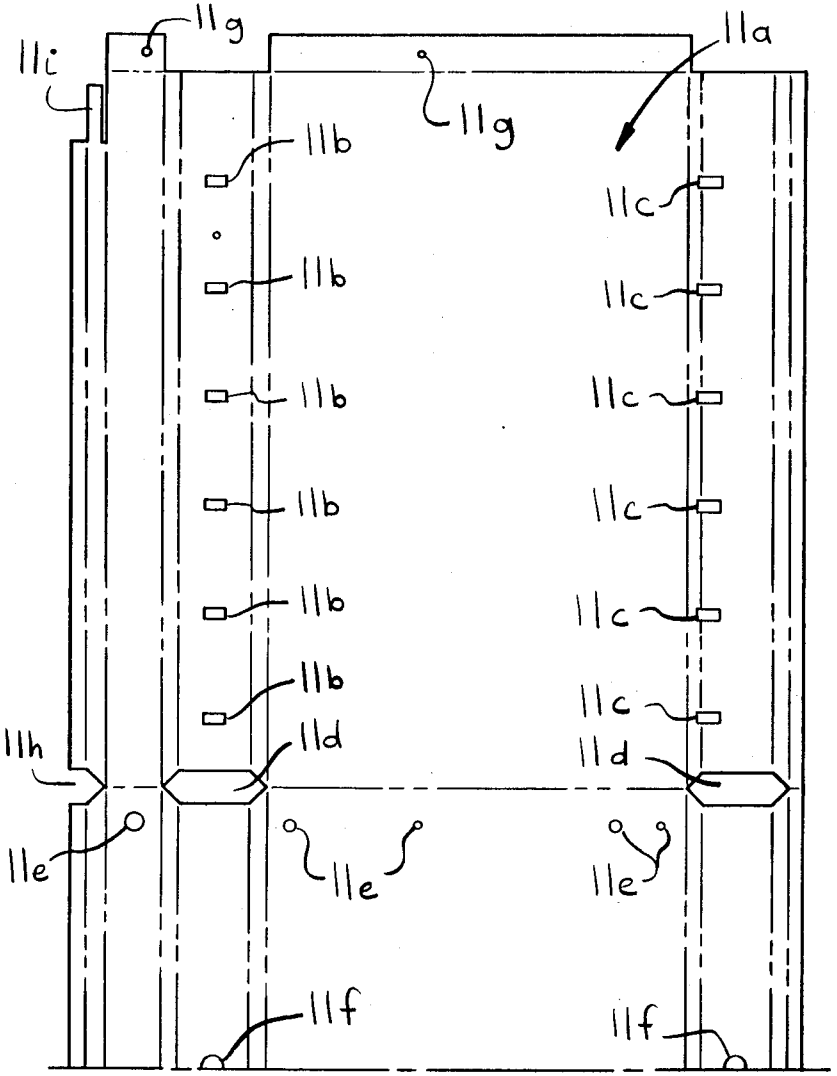
Figure 3:
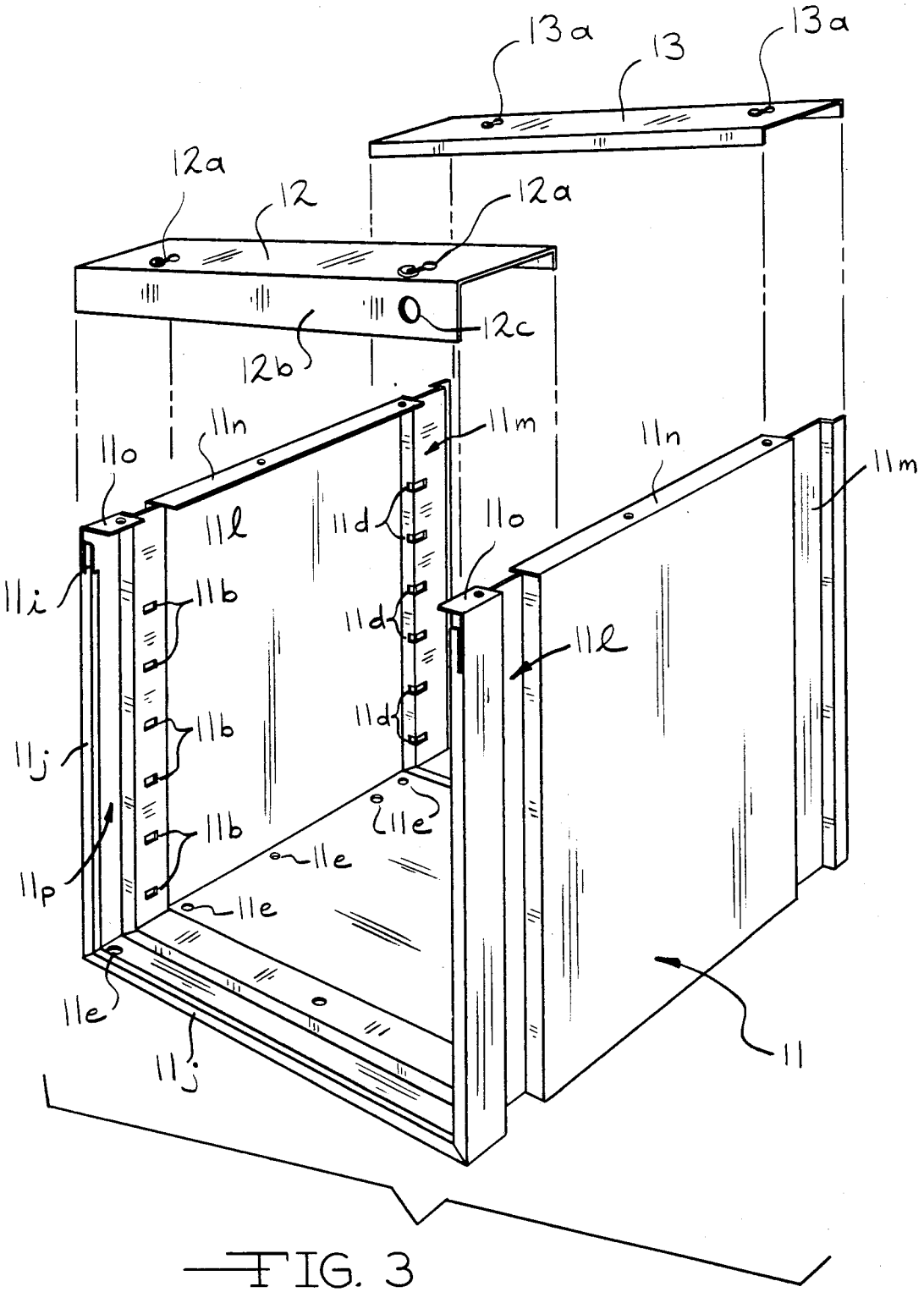

FIG. 1 is a plan view of pre-cut sheet metal 11*a* for forming one-half of the box shaped member 11 shown in FIG. 3 providing the core of the cabinet 10 prior to bending of the metal, showing dotted bending lines.

FIG. 2 is a plan view of partially formed sheet metal for providing the box shaped member 11 shown in FIG. 3.

FIG. 3 is a perspective view showing the completely formed box shaped member 11 with beams 12 and 13 which rigidify the box shaped member 11.

Figure 4:
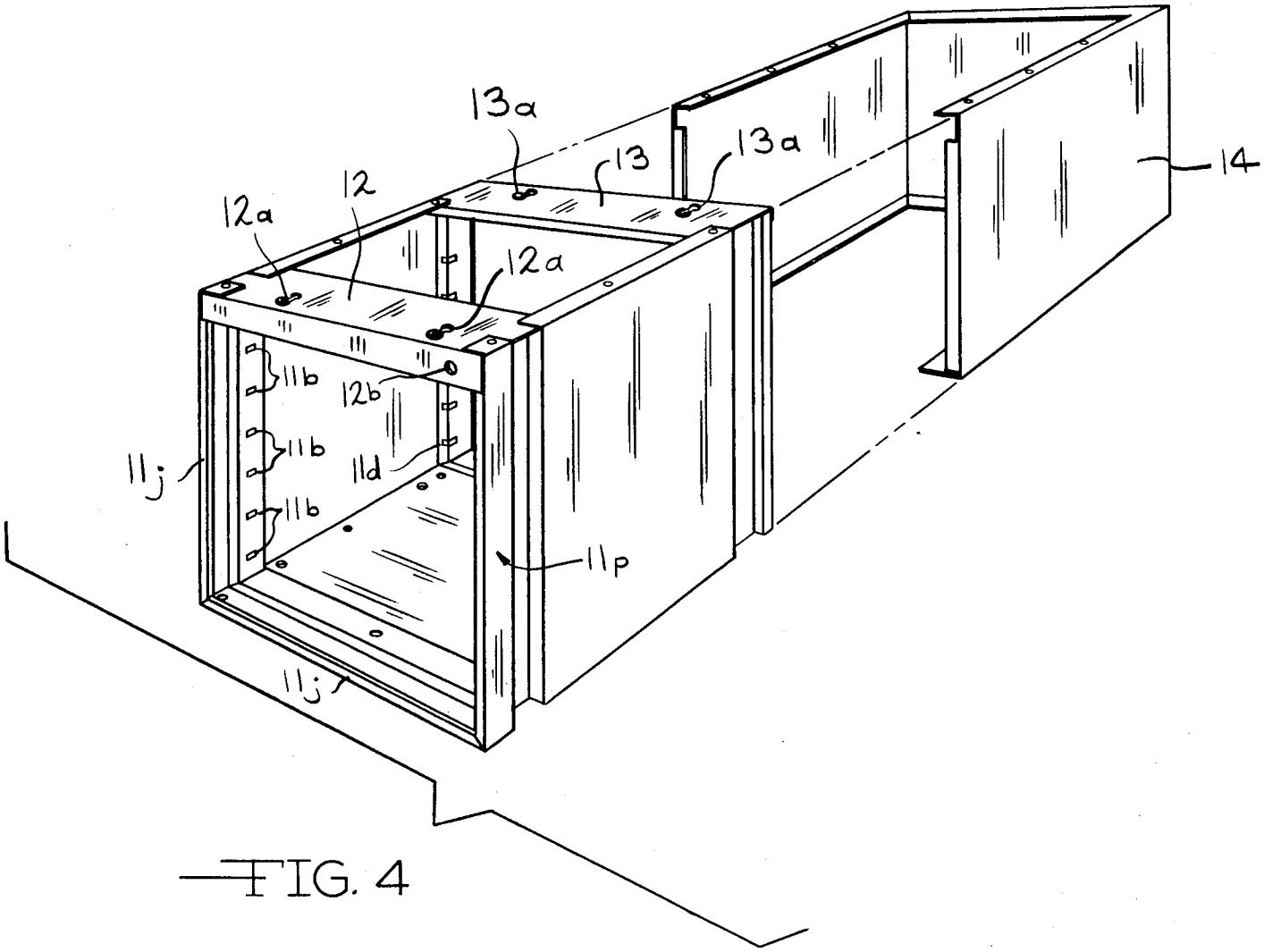
Figure 7:
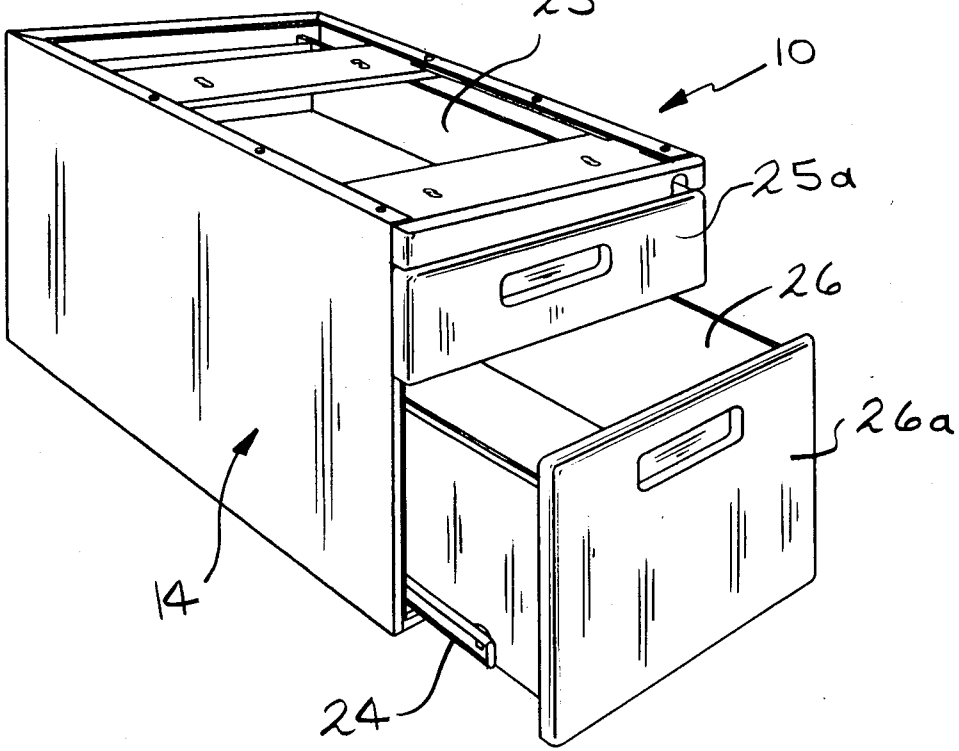
Figure 6:
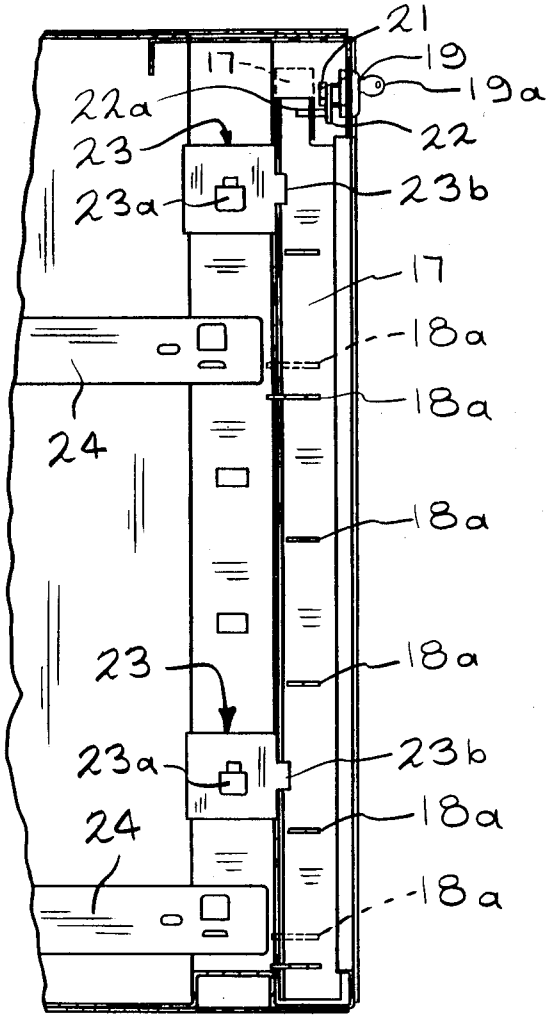

FIG. 4 shows the box shaped member 11 with a wrap-around cover 14 which defines an enclosure for the drawers as shown in FIGS. 6 and 7.

Figure 5:
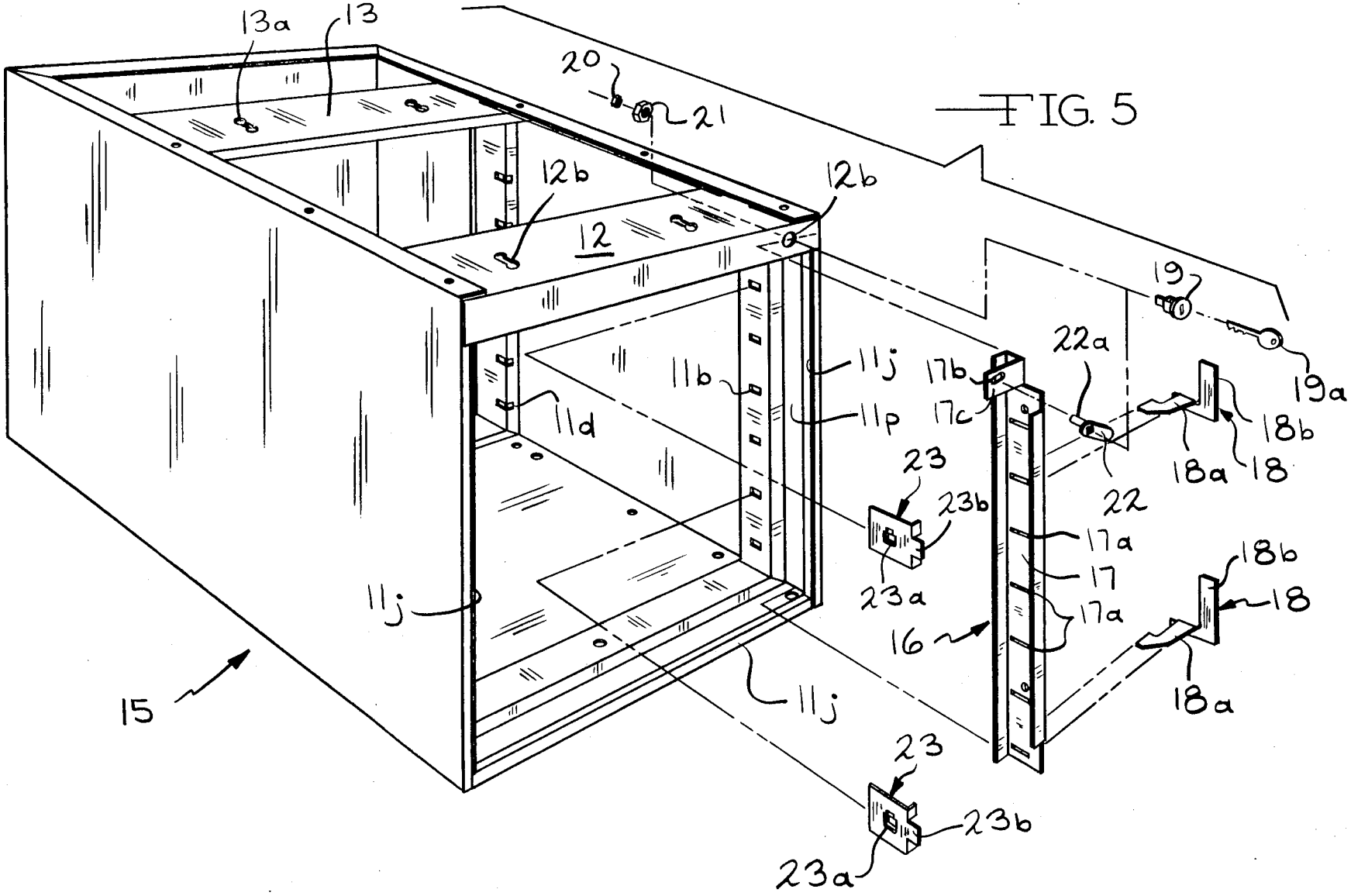

FIG. 5 is a perspective view showing the lock subassembly 16 with dotted lines defining the positions of various elements in the box shaped member 11.

FIG. 6 is a cross-sectional view of the cabinet subassembly 15 without drawers showing the portions 18*a* of the stop members 18 in an unlocked position in solid lines and in a locked position in dotted lines when moved by slide member 17.

FIG. 7 is a front perspective view of the cabinet and drawer assembly 10 with one of the drawers 26 in a partially open position when the lock 19 is unlocked by a key 19*a*.

GENERAL DESCRIPTION

The present invention relates to an improved drawer and cabinet assembly with an open front from which the drawers are pulled out horizontally and with side walls, a bottom and top defining the cabinet wherein the cabinet supports at least one drawer moveable into and out of the cabinet on dual sliding tracks mounted on the sides of the cabinet which telescope from the open front of the box shaped member and including stop means activated by a key and lock means which move to prevent the drawers from opening by blocking movement of one of the sliding tracks which comprises: a vertically oriented recess on one of the sides of and inside the cabinet adjacent the open front; a rectangularly cross-sectioned slide member positioned in horizontal cross-sectional mating relationship with the recess on the one side of the cabinet so that there is limited vertical sliding movement of the slide member in the recess, wherein the slide member has at least one opening along its length facing inside the cabinet; clip means mounted on the cabinet adjacent the slide member over the recess which holds the slide member in the recess and allows vertical sliding movement of the slide member in the recess; at least one stop member mounted through the opening in the slide member and projecting from the slide member into the inside of the cabinet and moveable with the slide member to block one of the sliding tracks, wherein the stop member has a head portion which holds the stop member in the opening in the slide with the head portion engaging the recess; and lock means with a lever means which projects from the lock means and engages with the slide member wherein the lever means rotates by turning of a key in the lock to move the slide member vertically in the recess to thereby position the stop member to prevent the drawers from opening.

In particular the present invention relates to a drawer and cabinet assembly wherein the drawers are mounted on two horizontally sliding tracks for opening and closing the drawers which comprises: a unitary box shaped member defining opposed sides and a bottom with front and rear openings, with a vertically oriented horizontally rectangularly cross-sectioned integral recess around and inside the box shaped member adjacent a front portion of the sides and the bottom of the box shaped member and with a lip projecting into the front opening from the sides of the front portion of the member; a beam means welded to the box-shaped member to rigidify the box shaped member; a horizontally rectangular cross-sectioned slide member positioned in mating cross-sectional relationship with the recess on one of the sides of the box shaped member and the under lip on the one of the sides so that there is limited sliding movement of the slide member vertically, wherein the slide member has at least one opening along its length facing inside the box shaped member; at least one stop member mounted in the opening in the slide member and projecting perpendicular to the slide member into the inside of the box shaped member and moveable with the slide member to block one of the sliding tracks, whereln the stop member has a head portion which holds the stop member in the opening in the slide member with the head engaging the recess; lock means with a lever means which projects from the lock means into engagement with the slide member, wherein the lever means rotates by rotation of a key in the lock to move the slide member vertically in the recess; clip means which is mounted adjacent to the recess and extends over the recess and holds the slide member in position in the recess; and at least one drawer horizontally mounted in the box shaped member on the sliding tracks, wherein the stop member the slide member engages the one of the sliding tracks to prevent the drawer from opening when the key is turned in the locking means into a locked position as a result of rotation of the lever means and movement of the slide member and stop member.

SPECIFIC DESCRIPTION

FIGS. 1 to 6 show the stages in the construction of the drawer and cabinet assembly 10 as shown in FIG. 7. The construction of the assembly 10 starts with the stamping of sheet metal to form the box shaped member 11 shown in FIG. 3.

As shown in FIG. 1 sheet metal is stamped to the shape 11*a* including openings 11*b*, 11*c*, 11*d*, 11*e*, 11*f*, 11*g* and 11*h*. Mounting tab 11*i* is provided for the brace or beam 12. Openings 11*e*, 11*f* and 11*g* are optional mounting openings and do not require further discussion. The dotted lines show where the metal is to be bent as is partially shown in FIG. 2.

FIG. 2 shows the formation of lips 11*j* and 11*k* and channels 11*l* and 11*m* as well as tabs 11*n* and 11*o*. A recess 11*p* is provided for the drawer lock subassembly 16 shown in FIG. 5. As shown in FIG. 3, beams or braces 12 and 13 are mounted on the box shaped member 11 adjacent tabs 11*o* and 11*r* to provide rigidity. The braces 12 and 13 are provided with openings 12*a* and 13*a* for mounting of the finished cabinet 10 to a desk top (not shown) or the like and do not require further discussion. A front angled portion 12*b* of the brace 12 is provided with an opening 12*c* on one side for a lock 19 (FIGS. 5 and 6).

FIG. 4 shows the box shaped member 11 and the braces 12 and 13 in position. A covering wrapper 14 is provided to enclose the box shaped member 11 on opposed sides to prevent access to the drawers 25 and 26 shown in FIG. 7.

The resulting cabinet subassembly 15 shown in FIG. 5 is ready for mounting of the locking subassembly 16 as shown by the dotted lines. A slide member 17 which is horizontally rectangularly cross-sectioned mounts T shaped stop members 18 through openings or slots 17*a* in the slide member 17. The stop members 18 have a portion 18*a* which projects through the openings 17*a* into the inside of the subassembly 15 and a head portion 18*b* which extends vertically engages the recess 11*p* to hold the stop member 18 in position. The slide member 17 is provided with a tab 17*b* which is positioned adjacent to the opening 12*c*. The lock 19 is held in place in opening 12*b* by nuts 20 and 21. A lever 22 is secured to lock 19 inside the subassembly 15 with an arm 22*a* projecting perpendicular to the tab 17*c* of slide member 17. The arm 22*a* is mounted in opening 17*b* on projection 17*c* of slide member 17. Clips 23 mount in openings 11*b* by means of tabs 23*a* which slide vertically into the openings 11*b*. Extension 23*b* is positioned over the recess 11*p* to hold the slide member 17 in position so that it can vertically slide.

As can be seen from the portions 18*a* of stop member 18 in FIG. 6, the sliding tracks 24 are allowed to move when the arm 22*a* is in its lowermost position as determined by the lock lever 22 and lock 19 by turning the key 19*a*. When the lock 19 is rotated, the slide member 17 moves up and the stop members 18 block the movement of the slides 24.

FIG. 7 shows the cabinet 10 and drawer 25 and 26 assembly with the lock 19 unlocked so that the drawers 25 and 26 can open. The drawers 25 and 26 are standard and have decorative front portions 25*a* and 26*a*.

It is intended that the foregoing description be only illustrative of the present invention and that the invention be limited only by the hereinafter appended claims.

I claim:

1. In a drawer and cabinet assembly with an open front from which the drawers are pulled out horizontally and with side walls, a bottom and top defining the cabinet wherein the cabinet supports at least one drawer moveable into and out of the cabinet on dual sliding tracks mounted on the sides of the cabinet which telescope from the open front of the box shaped member and including stop means activated by a key and lock means which move to prevent the drawers from opening by blocking movement of one of the sliding tracks the improvement which comprises:

(a) a vertically oriented recess rectangular in cross-section on one of the sides of and inside the cabinet adjacent the open front;

(b) a rectangularly cross-sectioned slide member positioned in horizontal cross-sectional mating relationship with the recess on the one side of the cabinet with limiting means so that there is limited vertical sliding movement of the slide member in the recess, wherein the slide member has at least one opening along its length facing inside the cabinet;

(c) removable clip means mounted on the cabinet adjacent the slide member and extends across the recess which holds the slide member on the recess and allow vertical sliding movement of the slide member in the recess;

(d) at least one stop member having two perpendicular portions with one portion extending through the opening in the slide member and projecting from the slide member into the inside of the cabinet and moveable with the slide member from a first position where the stop member is vertically spaced from the sliding tracks to a second position where the stop member is in front of the tracks and prevents the sliding tracks from sliding, wherein the other portion of the stop member is a head portion which holds the stop member in the opening in the slide with the head portion extending along the recess; and (e) lock means with a lever means which projects from the lock means and engages with the slide member, wherein the lever rotates by turning of a key in the lock to move the slide member vertically in the recess to thereby position the stop member to prevent the drawers from opening.

2. The assembly of claim 1 wherein there are at least two drawers and two stop members projecting from two openings in the slide member which block the one of the sliding tracks of at least two drawers.

3. The assembly of claim 1 wherein tabs on the clip means slide into holes in the cabinet adjacent the recess in the cabinet to hold the slide member in place for the vertical sliding movement.

4. A drawer and cabinet assembly wherein the drawers are mounted on two horizontally sliding tracks for opening and closing the drawers which comprises:

(a) a unitary box shaped member defining opposed sides and a bottom with front and rear openings, with a vertically oriented horizontally rectangularly cross-sectioned integral recess around and inside the box shaped member adjacent a front portion of the sides and the bottom of the box shaped member and with a lip projecting into the front opening from the sides of the front portion of the member;

(b) a beam means welded to the box-shaped member to rigidify the box shaped member;

(c) a horizontally rectangular cross-sectioned slide member positioned in mating cross-sectional relationship with the recess on one of the sides of the box shaped member and the under lip on the one of the sides so that there is limited sliding mevement of the slide member vertically, wherein the slide member has at least one opening along its length facing inside the box shaped member;

(d) at least one stop member having two perpendicular portions having one portion extending through the opening in the slide member and projecting perpendicular to the slide member into the inside of the box shaped member and moveable with the slide member from a first position where the stop member is vertically spaced from the sliding tracks to a second position where the stop member is in front of the tracks and prevents the sliding tracks from sliding, wherein the other portion is has a head portion which holds the stop member in the opening in the slide member with the head portion extending along engaging the recess;

(e) lock means with a lever means which projects from the lock means into engagement with the slide member, wherein the lever means rotates by rotation of a key in the lock to move the slide member vertically in the recess;

(f) removable clip means is mounted on the cabinet adjacent to the recess and across the recess and holds the slide member in position in the recess; and (g) at least one drawer horizontally mounted in the box shaped member on the sliding tracks, wherein the stop member on the slide member engages the one of the sliding tracks to prevent the drawer from opening when the key is turned in the locking means into a locked position as a result of rotation of the lever means and movement of the slide member and stop member.

5. The assembly of claim 4 wherein there are at least two drawers and a stop member for each drawer which can engage the one of the sliding tracks for each drawer.

6. The assembly of claim 4 wherein tabs on the clip means slide into holes adjacent the recess to hold the clips in place.

7. The assembly of claim 4 wherein an integral horizontally rectangular cross-sectioned channel is provided adjacent the recess opposite the lip and a rear portion of the box. shaped member to provide rigidity to the box shaped member.

8. The assembly of claim 4 wherein the beam means comprises spaced apart beams welded to the box shaped member.

9. The assembly of claim 8 wherein an integral closure wrapper is provided on the rear portion and sides of the box shaped member.

10. The assembly of claim 4 wherein the beam means comprises two beams which are secured adjacent the front and rear portions of the box shaped member.

11. The assembly of claim 9 wherein the beam adjacent the front portion has a vertical extension which mounts the lock means adjacent the recess and slide member.

12. The assembly of claim 11 wherein an integral closure wrapper is provided on the rear portion and sides of the box shaped member.

13. The assembly of claim 12 wherein there are at least two drawers and a stop member which can engage the one of the sliding tracks for each drawer.

14. The assembly of claim 13 wherein tabs on the clip means slide into holes adjacent the recess to hold them in place.

15. The assembly of claim 14 wherein an integral rectangular cross-sectioned channels are provided adjacent a rear portion and the recess opposite the lip of the box shaped member to provide rigidity.

* * * * *

UNITED STATES PATENT AND TRADEMARK OFFICE

CERTIFICATE OF CORRECTION

PATENT NO. : 4,761,045

DATED : 1988 August 2

INVENTOR(S) : George W. Paine

It is certified that error appears in the above-identified patent and that said Letters Patent are hereby corrected as shown below:

Column 3, line 5 "whereln" should be --wherein--.

Column 3, line 17, after "member" insert --on--.

Column 4, line 45, "on" should be --in--.

Column 4, line 46 "allow" should be --allows--.

Column 4, line 55, before "tracks" insert --sliding--.

Column 5, line 26, "mevement" should be --movement--.

Column 5, line 39, delete "has".

Column 5, line 42, delete "engaging".

Column 6, line 21, delete the period "." after "box".

Column 6, line 46 "channels are" should be --channel is--.

Signed and Sealed this

Seventh Day of February, 1989

*Attest:*

DONALD J. QUIGG

*Attesting Officer*

*Commissioner of Patents and Trademarks*